US005513512A

United States Patent [19]

Segal

[11] Patent Number: 5,513,512

[45] Date of Patent: May 7, 1996

[54] PLASTIC DEFORMATION OF CRYSTALLINE MATERIALS

[76] Inventor: Vladimir Segal, 1831A Wild Oak Cir., Bryan, Tex. 77802

[21] Appl. No.: 261,931

[22] Filed: Jun. 17, 1994

[51] Int. Cl.[6] ..... B21C 23/00

[52] U.S. Cl. ..... 72/253.1; 72/377

[58] Field of Search ..... 72/253.1, 260, 72/263, 264, 377

[56] References Cited

U.S. PATENT DOCUMENTS 3,146,886 9/1964 Scribner ..... 72/260

*Primary Examiner*—Daniel C. Crane

*Assistant Examiner*—Ed Tolan

*Attorney, Agent, or Firm*—Ilya Zborovsky

[57] ABSTRACT

A method of plastic deformation of metals, alloys and other crystalline materials for controlling their structure and texture comprises the steps of extruding a workpiece through two intersecting passages having equal cross-sections corresponding to a cross-section of a workpiece, the pressing including determining during each passage of a workpiece three main directions corresponding to a flow direction, a perpendicular to the flow plane, and a perpendicular to the first mentioned and second mentioned directions, changing the directions during placement of a workpiece in its initial position for each passage relative to a corresponding position in a predetermined passage by turning the workpiece by a predetermined angle around axes of the main directions, and cyclically repeating the method.

5 Claims, 6 Drawing Sheets

PLASTIC DEFORMATION OF CRYSTALLINE MATERIALS

BACKGROUND OF THE INVENTION

The present invention relates to a method of plastic deformation of crystalline materials.

More particularly, it relates to a method of plastic deformation of metals, alloys and other crystalline materials which allows controlling of structure and texture of such materials.

Controlling of structure and texture of materials is one of the most important ways to improve properties of metals and alloys. Processes of plastic deformation are very important in a general cycle of thermal mechanical treatment, including various combinations of thermal and mechanical action upon the material to be worked. Objectives of structure formation or in other words of regulation of size and shape of grains and development of a complicated internal grain substructure are versatile. Sometimes the problem is a substantial reduction of grain size in one direction in tenths and hundreds thousands times and formation of a laminated structure. For example for copper-niobium composites manufactured in situ, it is possible with this approach to obtain superhigh strength of more than 2,000 MPA of a conductive material. However, with known technical means these results can be obtained only for very thin bands and foils with a final thickness of approximately 0.01 mm. In other cases it is necessary to provide multiple reduction of the grain size in two directions with substantial increase of their size in a third direction, which results in formation of fiber structures. For example a method of producing high strength and ductile thin wire of tungsten is known by substantial drawing with a gradually reducing temperature from sintered brittle workpiece. As for obtaining of such results for articles having great masses, this is now practically impossible. In certain situations however it is necessary to obtain the exact correspondence between maximum and minimum sizes of grains (aspect-ratio). On the other hand, for great variety of objectives, the plastic deformation is used for development of greatly deformed, but equiaxial grain structures. Thereby it is possible to obtain sub-micronic and nano crystalline structures for many industrial alloys, which have high strength and ductility. One of the important technical applications of this effect is elimination of brittleness of intermetallic alloys at room temperature.

The above described structural changes during plastic deformation are usually accompanied by development of corresponding textures, or in other words predominantly crystalline orientation of grains. Strong texture is a main factor which determines high characteristics of magnetic materials, or strength and toughness of titanium alloys. However, similarly to the structure formation, there are substantial difficulties in controlling texture with known technical methods.

In order to form different types of structures and textures, specific methods of plastic deformation are utilized. The laminated structures and corresponding complete textures are formed by flat rolling as disclosed for example in U.S. Pat. Nos. 3,954,516, 4,080,715, 4,406,715, 4,609,408, 4,722,754. Fibrous structure and corresponding axial textures are obtained during pulling of a material in one direction by axis-symmetrical drawing, pressing and rotary forging as disclosed for example in U.S. Pat. Nos. 4,336,075, 4,511,409, 5,074,907, 5,145,512, 5,120,373. Equiaxial structures and full textures are developed during twisting and special sequence of forging operation as disclosed for example in U.S. Pat. Nos. 3,645,124 and 5,039,356. Equiaxial structures in a textureless material can be made during a multi-stage forging with equal squeezing in three mutually perpendicular direction as disclosed in U.S. Pat. Nos. 3,954,514, 4,466,842 and 4,712,537. The above described methods have substantial disadvantages, in particular as follows:

—High specialization of each method of deformation in development of one specific type of a structure and texture. Thus, rolling is specific for production of laminated structures and full textures, while drawing is specific for obtaining fibrous structures and axial textures. For this reason corresponding types of textures are called textures of rolling and drawing. Other types of structures and textures cannot be obtained by means of these methods.

—There are strict limitations with respect to a geometric shape of material in which a certain type of structure and texture is produced. For example, laminated structure and full texture is obtained in sheet and bands, however, it cannot be made for workpieces of round or square cross-section. On the other hand fibrous structure and axial texture are natural for round cross-sections, but cannot be reproduced for flat sheets and plates. Similarly, a non-textured material with heavily deformed equiaxial structure can be obtained only for articles with small difference in side ratio, in other words close to cubic articles.

—For substantial change of structure and texture of a material to be worked it is necessary to significantly change its shape which is characterized by reduction of its cross-section or in other words a ratio of the area of cross-section of an initial workpiece to a final article. The achieved results increase when the reduction is increased, which in many cases must be tenths and hundreds and sometimes thousands times. Therefore when known methods of plastic deformation are used, high series of properties can be obtained only for articles of substantially small cross-sections such as sheet, foil and thin wire while for enough massive articles the level of properties are always lowered.

—Large non-uniformity of strains and deformed conditions during the processing, which substantially reduces properties of the articles.

—Necessity to use significant reductions leads to high working pressures and forces such as for example for extrusion, or to high labor consumption and time of working such as for example in the case of multi-stage rolling, drawing and forging.

The closest process type to the present invention is a method of equal channel angular extrusion with the use of deformation of simple shear as a metalworking process. The method is proposed by the applicant and disclosed in the inventor's certificate of the USSR number 575892 of Oct. 22, 1974. Some elements of the method are disclosed in publications:

[1] Segal V. M. and others. "Plastic Working of Metals by Simple Shear." English translation: "Russian Metallurgy", No. 1, pp. 99–105, 1981.

[2] V. M. Segal. "Working of Metals by Simple Shear Deformation Process." In "Proceedings 5th Aluminum Extrusion Technology Seminar", vol. 2, pp. 403–406, Chicago, 1992.

[3] V. M. Segal. "Simple Shear as Metalworking Process for Advanced Materials Technology". In "Proceeding First International Conference on Processing materials for Properties", pp. 947–950, Hawaii, November, 1993; and also in the inventor's certificates of the USSR numbers 492780, 780293, 804049, 812401, 902884.

This method is illustrated in FIG. 1. The tool is a die set 1 having two intersecting channels 2 and 3 with an equal cross-section D. The initial workpiece 4 is lubricated and has approximately the same cross-section D. It is placed into the first channel and under the action of plunger 5 is pressed out into the second channel. During this process a deformation is performed by a simple shear with high intensity along the plane of intersection of the channels A—A. When the plunger reaches its lower position B—B, it retracts and the workpiece is removed from the second channel. Therefore the whole volume of the material with the exception of relatively small ends can be uniformly and intensely ready-formed without changing the area of cross-section of the initial material. The above mentioned process can be repeated many times in the same tool, so that extremely high equivalent deformations can be obtained in great articles. Moreover, the process is characterized by low pressure applied to the instrument and small working forces.

The method of equal channel angular extrusion eliminates some above mentioned disadvantages of the traditional methods of plastic deformation. However, it has been recognized that the advantages of the method are obtained in the cases when the final effect of plastic working is determined only by the total quantity of accumulated deformation as for example in the case of break-down of cast metal, strain hardening, consolidation of porous metals, and some others. In the cases when the effect of plastic working is connected with control of structure and texture, there is indefiniteness of the results which sometimes become even negative. Therefore, in addition to the known method of equal channel extrusion it is necessary to develop a special process of its realization, which eliminates the above mentioned controversy and provides principally new possibilities of controlling structure and texture during a plastic deformation.

SUMMARY OF THE INVENTION

Accordingly, it is an object of the present invention to provide a method of plastic deformation which eliminates the disadvantages of the prior art.

More particularly, it is an object of the present invention to provide a method of plastic deformation in which for obtaining various types of structures and textures and improving physical-mechanical properties of the material to be worked, three main directions are fixed in a workpiece which correspond to a direction of flow, a direction which is perpendicular to the flow plane, and a direction which is perpendicular to the first mentioned two directions, which are changed with placement of a workpiece in its initial position during a further channel relative to a corresponding position during a preceding channel by turning of the workpiece over predetermined angles around axes of these main directions, and the process is cyclically repeated after a predetermined number of passes.

When the method is performed in accordance with the present invention, it eliminates the disadvantages of the prior art and provides for the above mentioned advantageous results.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
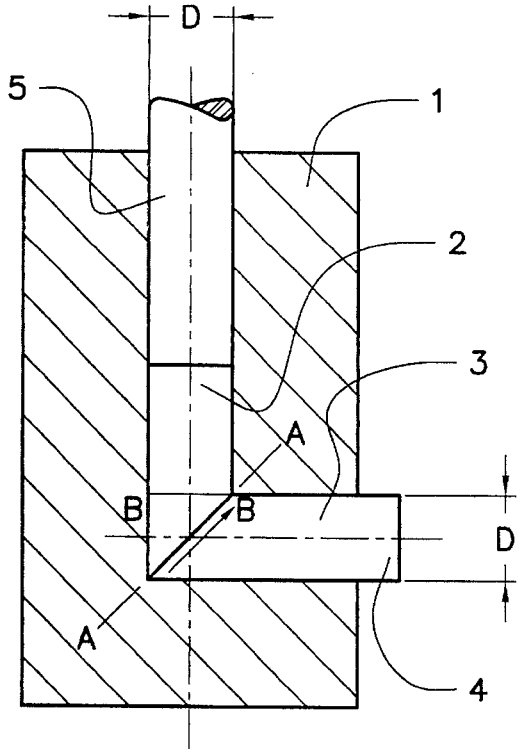
FIG. 1 is a view showing a prior art method of plastic deformation.

In accordance with the present invention, deformation is performed by a method of equal channel angular extrusion shown in FIG. 1 by repeated extrusion of a workpiece through two intersecting channels of equal cross-section corresponding to a cross-section of the workpiece. For reducing contact friction and providing a pattern of deformation corresponding to a simple shear, the workpiece and the tool are lubricated before each passage. In accordance with the present invention in a workpiece to be deformed three main directions are selected which determine its orientation during each passage. The orientation of the workpiece is changed before each subsequent passage when compared with its initial orientation during a preceding passage, by turning the workpiece by predetermined angles around axes of the main directions. Standard systems of changing orientation of the workpiece between the successive passages is utilized for obtaining certain types of structures and textures. A cyclical repetition of the changes of the orientation of the workpiece is performed after a certain number of the passages.

As an example a workpiece having a square cross-section is discussed hereinabove, while the explanations are of course applicable to workpieces having any other cross-sections. But it is supposed in all cases a workpiece length is significantly bigger, at least 2.5–3 times, of transverse dimensions.

Figure 2:
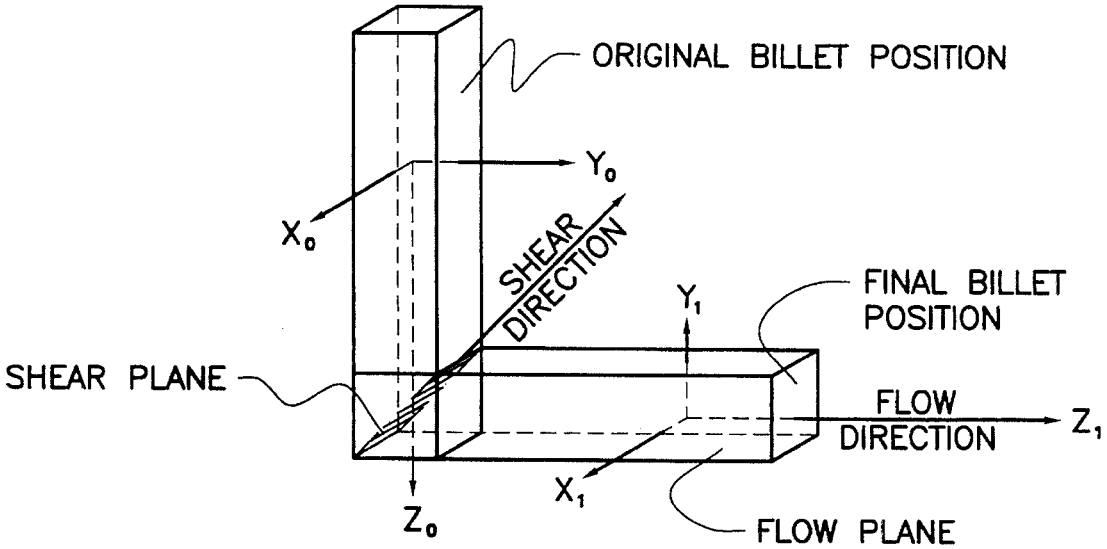
FIG. 2 is a view showing three main directions of a workpiece after its channel through a tool.

FIG. 2 shows three main directions of a workpiece after a passage;

—a direction of flow corresponding to a longitudinal axis of a workpiece Z;

—first transverse direction corresponding to a perpendicular to a plane of flow X;

—second transverse direction corresponding to a perpendicular to the two preceding directions Y.

The direction of these axes in an initial position of a workpiece when it is placed into the tool, in a predetermined passage is designated as X0, Y0, Z0 as shown in FIG. 2.

There is a great variety of changes of the system of orientation of a workpiece between successive passages. However, some of them are necessary for purposeful and successive development of main types of structures and textures which have a practical interest. Such types are as follows:

(a) Reduction of a grain size in one direction and their elongation in another direction with predominantly maintaining an initial size in a third direction. The laminated structures developed in this way are similar to the structures of rolling, and full textures which correspond to them are similar to textures of rolling.

(b) Intensive plastic working of grains without substantial change of their shape, but with development of significant texture in a predetermined direction. Corresponding structures are equi-axial and the textures are flat angular.

(c) Reduction of a grain size in two directions during their pulling in a third direction. The developed fibrous structures are analogous to structures of drawing and pressing, and corresponding axial textures are analogous to textures of drawing.

(d) Intensive plastic working of grains without substantial change of their shape and development of noticeable structure. Corresponding structures are equi-axial in textureless material.

Figure 3A:
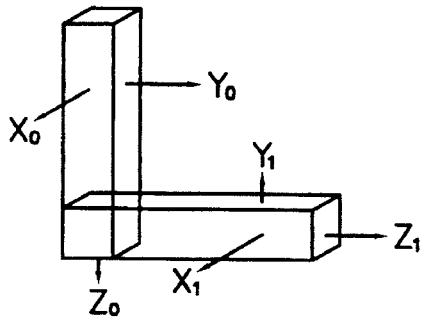
FIGS. 3*a* and *b* are views illustrating an optimum system of changing of orientation of workpiece between two successive passages for development of laminated rolling-like structures and textures.
Figure 3B:
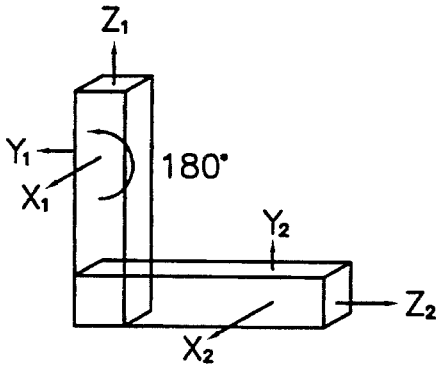

Hereinabove several examples of the method in accordance with the present invention are presented. FIG. 3 shows an optimal system changing the orientation of workpiece between subsequent passages for development of a laminated structure and texture similar to the structure and texture of rolling. After a first passage identified as a position 3*a*, three main directions are determined in a workpiece, which include a longitudinal direction Z1, a first transverse direction X1, and a second transverse direction Y1. Axes X0, Y0, Z0 correspond to the initial position of these directions during the first passage, or in other words during placement of the workpiece into the die. During placement of the workpiece to its initial position at the subsequent passage, or in other words position 3*b*, the workpiece is subjected to an additional turning by an angle of 180° around an axis of the first transverse direction X1. During this process the orientation of the axis X1 remains the same, but the axes Y1 and Z1 change their directions to opposite with respect to the directions Y0, Z0. The analogous process is repeated during each subsequent passage. As a result, the distortion of structural elements of a material such as grains, phases and separations caused by a shear, are added during all passages, which leads to an intense thinning of grains in direction of the axis Y and their elongation along the axis of the workpiece Z. As an example FIG. 4 shows the development of a fibrous micro-structure in a plane of flow for nickel, deformed in accordance with the proposed method with different number of passages (4*a* is a microstructure of an initial material, 4*b*, 4*c*, 4*d*, 4*e* are microstructures of material after one, two, three and four passages correspondingly; magnification is ×50). While the workpiece retained the initial shape, the obtained structures and textures are completely analogous to those obtained during rolling with great compressions. The advantage of this route is also the alternating change of the position of the upper and lower surfaces of the workpiece relative to the walls of the channel, which insures the uniformity of distribution of strain and homogeneity of properties over the cross-section of the workpiece during any number of passages.

It is possible to perform the method in accordance with a different orientation of workpieces for forming laminated structures, wherein main directions remain the same for all subsequent passages. However, the position of the upper and lower surfaces of the workpiece remain the same, which with the increase of the number of passages leads to increase of non-uniformity of properties caused by certain differences in contact friction over these surfaces.

Figure 5A:
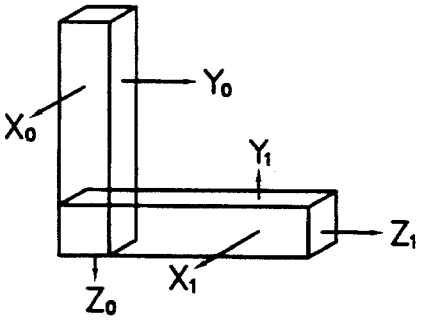
FIGS. 5*a* and *b* are views illustrating a method in accordance with a further embodiment of the present invention for obtaining equiaxial structures and flat angular textures.
Figure 5B:
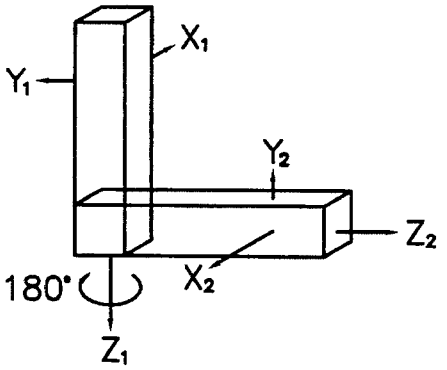
Figure 4A:
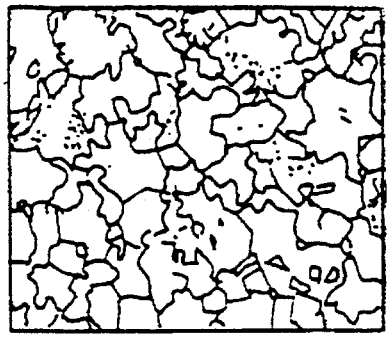
FIGS. 4*a*–4*e* show a development of laminated microstructure in a plane of flow for nickel deformed in accordance with the method of the invention of FIG. 3.
Figure 4B:
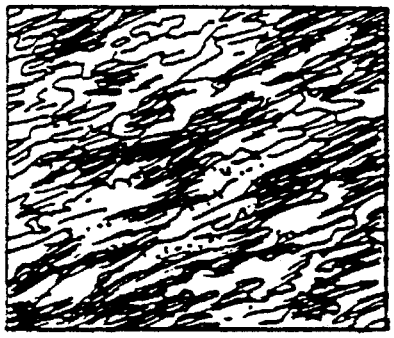
Figure 4C:
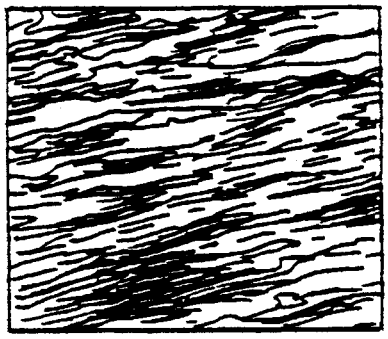
Figure 4D:
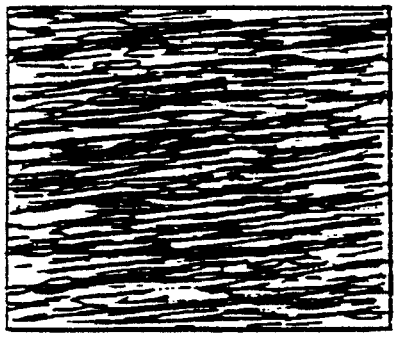
Figure 4E:
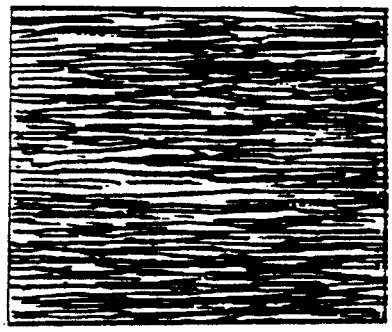
Figure 6A:
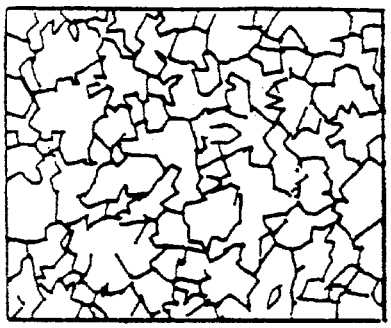
FIGS. 6*a*–6*d* show microstructures of a plane of flow for nickel deformed with different number of passes in accordance with the inventive method of FIG. 5.
Figure 6B:
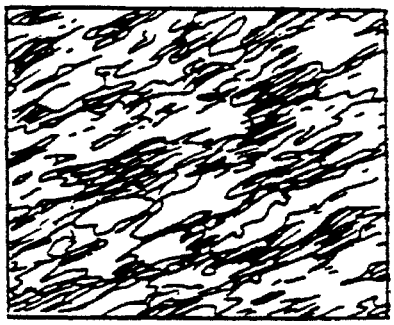
Figure 6C:
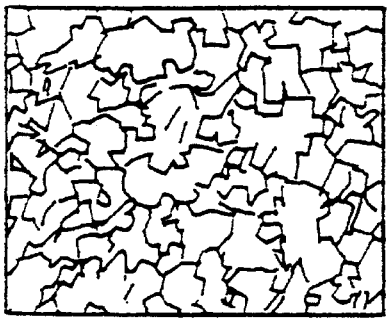
Figure 6D:
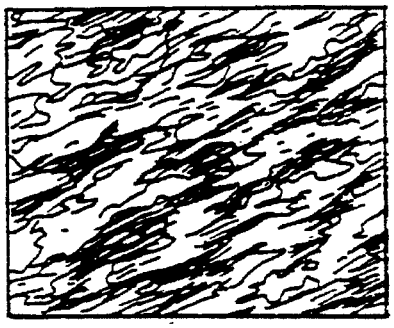
Figure 7A:
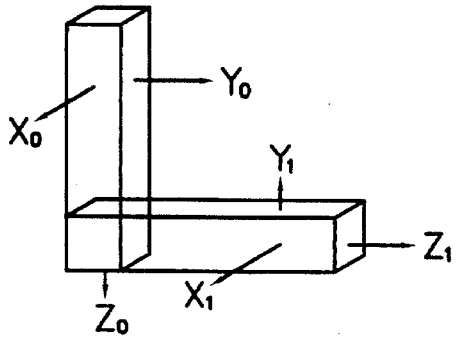
FIGS. 7*a*–7*d* are views showing a method in accordance with the present invention for obtaining fibrous structures and axial textures.
Figure 7B:
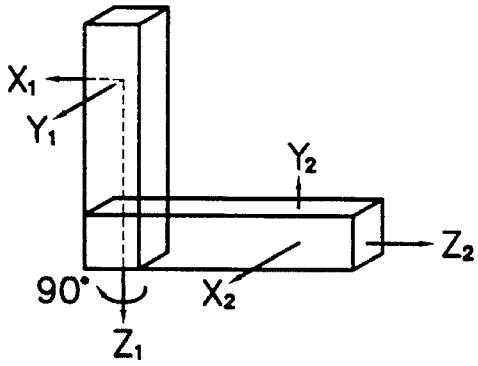
Figure 7C:
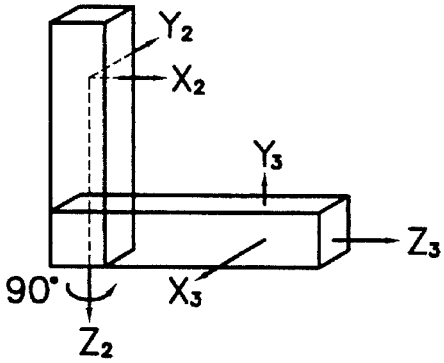
Figure 7D:
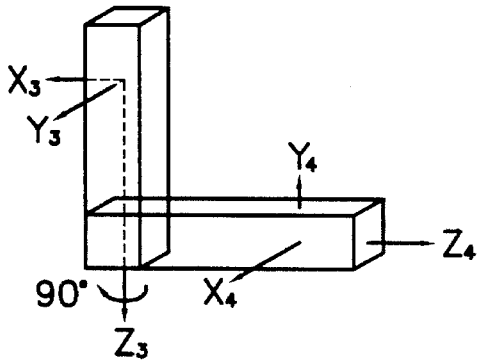
Figure 8A:
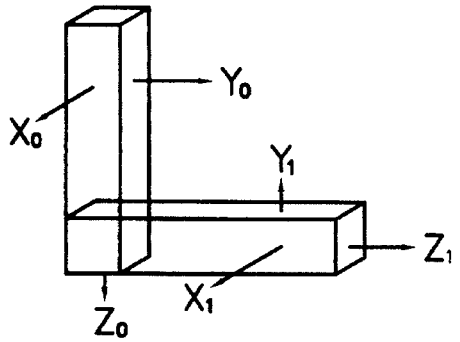
FIGS. 8*a*–8*d* are views showing an inventive method with orientation of workpiece in four subsequent passages for obtaining equiaxial structures in textureless materials.
Figure 8B:
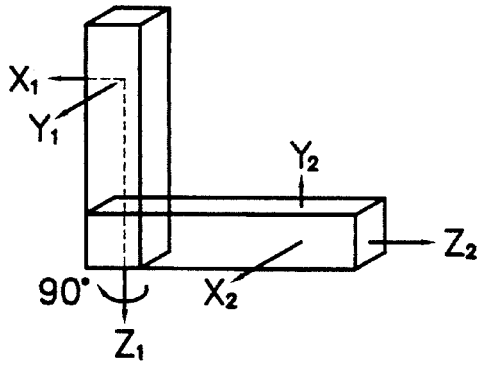
Figure 8C:
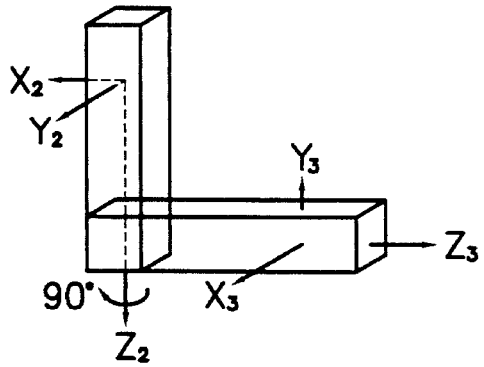
Figure 8D:
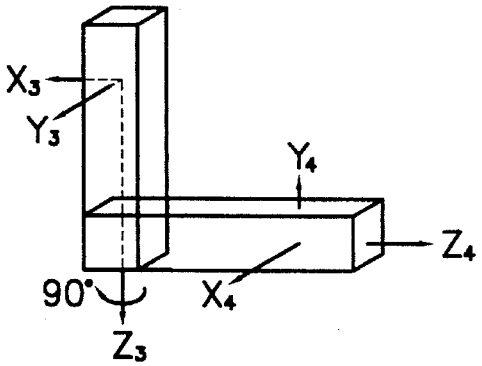

With another processing route, in order to provide development of equi-axial structure and flat angular texture, the orientation of the workpiece during each subsequent passage is changed by turning the workpiece by an angle 180° around the longitudinal axis Z as shown in FIG. 5, position 5*b*. The direction Z1 is retained, while the directions X1 and Y1 are changed to the opposite with respect to corresponding directions in the initial position during preceding passage, see position 5*a*, FIG. 5. Due to this operation, the position of the plane of shear is fixed, while the position of shear is periodically changed to reversed during the subsequent passages. As a result, the structural elements of the material periodically change their shape from the initial equi-axial shape to the elongated shape on each odd passage, and again restore the equi-axial shape during each even passage. Thereby after each even number of passages, substantially deformed and at the same time equi-axial grain structures are obtained and the process of orientation must be repeated after each pair of passages.

FIG. 6 shows an example of a micro-structure of a plane of flow of nickel deformed with different number of passages in accordance with the proposed method (6*a*, 6*b*, 6*c*, 6*d* are micro-structures after two, three, four and five passages; magnification ×50. The initial micro-structure and micro-structure after the first passage are the same as in FIGS. 4*a*, 4*b*). Corresponding texture analysis shows that the sign-changing shear in opposite directions of differently oriented grains leads to their turning and reconstruction of crystallographic systems of easy sliding along the plane and direction of simple shear, so that a flat angular texture is developed in this direction. Moreover, the above described system of orientation of a workpiece provides an exact reconstruction of the initial shape of grains and homogeneity of properties over the cross-section of the article.

Another system of orientation of workpiece is possible for forming equi-axial textured structures during which the workpiece is turned by an angle of 180° around its axis Y1 during each subsequent passage. However, this system does not insure a symmetrical restoration of the grain shape after even number of passages which leads to the development of non-homogeneity of properties with the increased number of passages.

For forming fibrous structures and axial textures, pulling and thinning of grains is performed in a certain sequence for two transverse directions of the workpiece. It is obtained by turning of the workpiece around its longitudinal axis by the angle of 90°. While during this process it is possible to provide various options, the best result which insure stable and uniform development of fibrous structure is obtained when alternating shear in each of the transverse directions is provided. This case is shown in FIG. 7. After the first passage (position 7*a*) main directions X1, Y1, Z1 are determined with their initial directions at this passage X0, Y0, Z0. During placing of the workpiece in its initial position on the second passage which is position 7*b*, it is turned around the axis Z1 by an angle of 90° so that the axis Z1 becomes parallel to Z0, while axes X1 and Y1 become perpendicular to X0, Y0. This leads to the change of a transverse direction of thinning of grains with respect to the first passage. During the third passage which is position 7*c*, the workpiece is again turned by angle 90° around the longitudinal axis Z1, but in direction which is opposite to the first direction. This procedure is repeated during each subsequent passage (see position 7*d* for fourth passage) and every time the direction of turning of the workpiece by angle 90° around its longitudinal axis is performed in a direction which is opposite to the direction of turning during the preceding passage. As a result, the grains are thinned in one transverse direction during the first and third passages, and in another transverse direction during the second and fourth passages, which leads to the formation of fibrous structures. The development of fibrous structures in each of the transverse directions in dependence on the number of passages in this direction is similar to that shown in FIG. 4 and the texture is analogous to the texture of drawing.

FIG. 8 shows an orientation of the workpiece during four subsequent passages in which strongly deformed and at the same time equi-axial structure is developed in a practically textureless material. This is achieved in that during each subsequent passage the workpieces turned around the longitudinal axis by the angle 90° in the same direction (see positions 8*a*, 8*b*, 8*c*, 8*d* for the first, second, third and fourth passages). Therefore for one transverse direction the position of the planes of shear is identical, while the direction of shear is opposite in the first and third passages, and for the other transverse direction it is opposite during the second and fourth passages. As a result the initial equi-axial shape of grain is restored in all directions after four passages. The thusly formed equi-axial structures of deformation are analogous to those shown in FIG. 6. The above described sequence of operations is repeated after each number of passages which is integer of 4.

When the method is performed in accordance with the present invention, it has several advantages. The method is universal, which provides obtaining of any structure and texture with the use of the same method of deformation and deforming device, only by changing of system of orientation of workpiece between subsequent passages. Various types of structures and textures can be formed in massive articles with an arbitrary shape of the cross-section. The homogeneity of the developed structure and texture is ensured, as well as physical-mechanical properties of the worked material. Low forces and pressures are needed for the working.

The method in accordance with the present invention has been tested in laboratory and semi-industrial conditions on wide class of materials including pure metals, such as aluminum, copper, nickel, and iron, structural and tool steels, high strength nickel based alloys, refractory alloys of molybdenum and tungsten, magnetic and superconductive alloys, and others. The new method has never been published or patented. Some references to it have been provided in my article, "Working of Metals by Simple Shear Deformation Process", in "Proceedings 5th Aluminum Extrusion Technology Seminar", vol. 2, pp. 403–406, Chicago, 1992. However, the subject matter of the present invention has not been disclosed. The same has been done in my presentation at the International Conference "Working of Materials for Properties", Honolulu, Hi., November, 1993 and published in works of the conference "Simple Shear as Metalworking Process for Advanced Materials Technology", in "Proceeding First International Conference in Processing Materials for Properties", pp. 947–950, Hawaii, November, 1993.

It will be understood that each of the elements described above, or two or more together, may also find a useful application for elongated billets in other types of methods differing from the types described above.

While the invention has been illustrated and described as embodied in a method of plastic deformation of crystalline materials, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of plastic deformation of metals, alloys and other crystalline materials for controlling their structure and texture, comprising the steps of extruding a workpiece through two intersecting passages having equal cross-sections corresponding to a cross-section of a workpiece, determining three main directions corresponding to a flow direction, a perpendicular direction to a flow plane, and a perpendicular to the first mentioned and second mentioned direction, extruding the workpiece through two intersecting passages, changing the directions during placement of a workpiece in its initial position for each passage relative to a corresponding position in a predetermined passage by turning the workpiece by a predetermined angle around axes of the main directions, and cyclically repeating the steps of determining, extruding and changing for a number of passes.

2. A method as defined in claim 1, wherein said step of turning includes turning the workpiece by the angle of 180° around an axis of the second mentioned direction which is perpendicular to the flow plane during each passage with respect to the preceding passage, so as to obtain a laminated structure.

3. A method as defined in claim 1, wherein said step of turning includes turning the workpiece by the angle of 180° around an axis of the third mentioned direction which is perpendicular to the first mentioned direction and second mentioned direction, said repeating includes repeating of an orientation system cyclically after each pair of subsequent passages, so as to obtain a substantially deformed equi-axial structure and a flat angular texture.

4. A method as defined in claim 1, wherein said step of turning includes turning the workpiece around a longitudinal axis by the angle of 90° in mutually opposite directions, said repeating includes repeating a system of orientation cyclically after each number of passages which is multiple of 4 so as to obtain a fibrous structure and axial texture.

5. A method as defined in claim 1, wherein said step of turning includes turning the workpiece around a longitudinal axis by the angle of 90° in the same direction, said repeating includes cyclically repeating of the system of orientation after each number of passages which is multiple of 4, so as to obtain greatly deformed equi-axial structure without noticeable texture.

* * * * *